US005895023A

United States Patent [19]

Chao

[11] Patent Number: 5,895,023

[45] Date of Patent: Apr. 20, 1999

[54] DOCUMENT HOLDER

[76] Inventor: David M. Chao, 6 Garden Ct., Apt. 2, Cambridge, Mass. 02138

[21] Appl. No.: 08/808,026

[22] Filed: Mar. 3, 1997

[51] Int. Cl.[6] ..... A47B 97/04

[52] U.S. Cl. ..... 248/451; 281/47; 281/49

[58] Field of Search ..... 248/460, 444, 248/160, 441.1, 462, 447, 451; 211/45; 281/47, 48, 50, 45, 51, 49

[56] References Cited

U.S. PATENT DOCUMENTS

| | | | |
|---|---|---|---|
| Re. 12,076 | 1/1903 | Walsh | 248/447 |
| 179,822 | 7/1876 | Sloan . | |
| 186,280 | 1/1877 | Sloan . | |
| 489,074 | 1/1893 | Edwards . | |
| 932,348 | 8/1909 | Stone, Jr. | 248/451 |
| 1,240,691 | 9/1917 | Feddern . | |
| 1,432,652 | 10/1922 | Zakrzewski | 281/47 |
| 1,575,534 | 3/1926 | Brinson | 248/451 |
| 3,875,720 | 4/1975 | Russell | 248/160 X |
| 5,590,674 | 1/1997 | Eppenbach | 248/160 X |

*Primary Examiner*—Ramon O. Ramirez
*Attorney, Agent, or Firm*—Burns, Doane, Swecker & Mathis, L.L.P.

[57] ABSTRACT

A document holder comprising two supporting members. Each supporting member includes an upper member which is aligned with an upper part of the document, a lower member which is aligned with a lower part of the document, and a resilient member which connects the upper portion to the lower portion and which exerts a bias force to make the upper portion substantially colinear with the lower portion. The newspaper is inserted between the two supporting members such that the horizontal crease of the document is aligned or overlaps with the resilient member. The resilient member allows the document to be folded up into a smaller size to facilitate reading, and exerts a bias force to open the document after a page has been read to facilitate page turning. The supporting members may include one or more mortise and tenon joints which allow the supporting members to be disengaged and folded for compact storage.

19 Claims, 8 Drawing Sheets

FIG. 3A
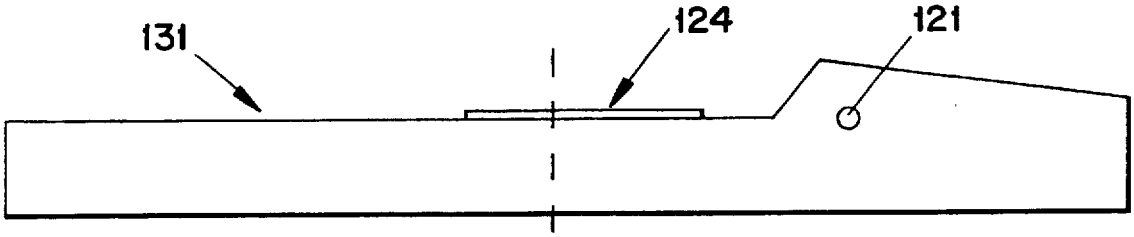
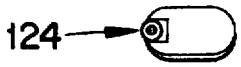
FIG. 3D
FIG. 3B
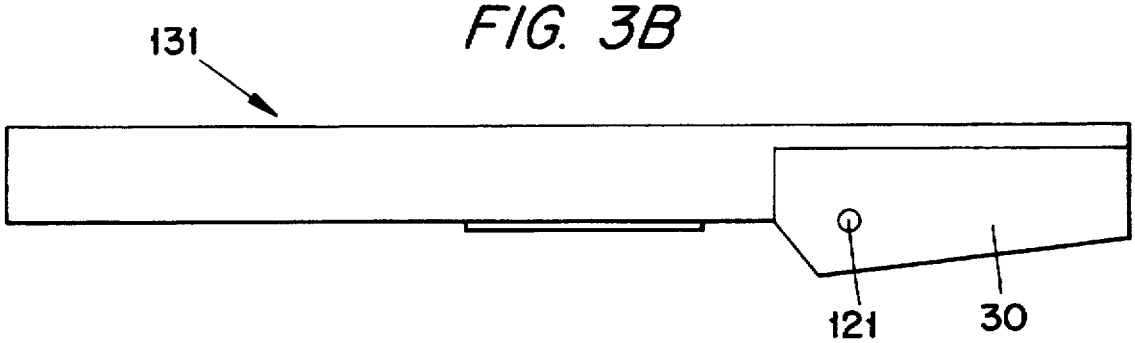
FIG. 3C
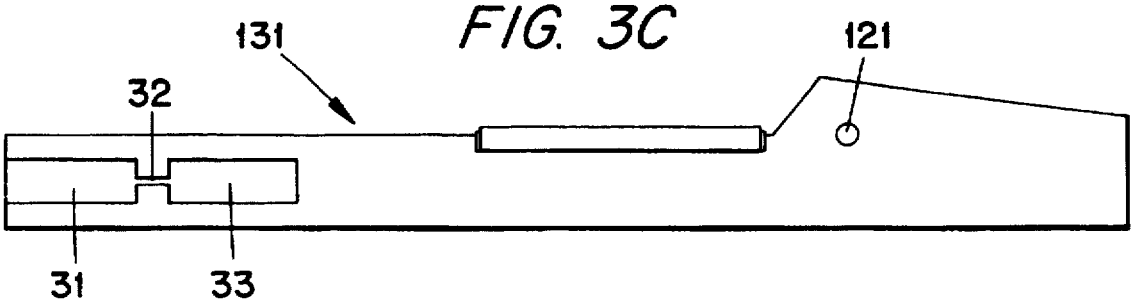

DOCUMENT HOLDER

BACKGROUND OF THE INVENTION

1. Field of the Invention

The present invention relates generally to a document holder, and more particularly, to a collapsible document holder which includes a resilient member.

2. Description of the Related Art

Newspapers and other periodicals have long been considered to be unwieldy and difficult to handle when reading because of the lack of a supporting binding and because of their relatively large size. For example, it is difficult to turn the large pages of a newspaper when the pages have shifted relative to each other, taking the central creases of the pages out of alignment. It is also difficult to fold the pages of a newspaper when the creases are not aligned. These and other factors may prevent a reader from full enjoyment of reading a newspaper, especially in a crowded or windy environment.

To assist readers in handling newspapers, holders have been devised which provide support to the newspaper so that the pages may be more easily manipulated. U.S. Pat. No. 1,240,691 to Feddern, for example, discloses a newspaper holder which includes U-shaped members into which the newspaper is inserted for support. The U-shaped members are connected via tubular sections to a pivot member which allows the device to be collapsed after use.

U.S. Pat. No. 489,074 to Edwards discloses another example of a newspaper holder which includes two or more sections connected by hinges. The hinges allow the holder and the newspaper to be bent backward for the convenience of a reader who wishes to be seated while perusing the newspaper.

Although the above-described newspaper holders may provide some degree of assistance to the reader, they have relatively limited utility due to their structure. For example, transporting the Feddern device is cumbersome since it is relatively bulky even in the collapsed state The pivot mechanism is unduly large and complicated. The device has many sharp edges which may tear a user's clothing during use or during storage in the collapsed position. In addition, the Feddern device is intended to remain in the unfolded position during use, making it difficult to use in crowded areas.

The Edwards device is not meant to be carried in a collapsed state by a user, but rather, is intended to be used in a library in a fully extended state. Also, the hinges of the Edwards device allow rotation only in one direction, so that the newspaper can only be folded in certain directions.

Accordingly, there is a need in the art for a newspaper holder that overcomes the drawbacks of the above-mentioned devices. In particular, there is a need for a newspaper holder that can be readily collapsed or folded into a smaller size for ease of storage or transport, and that has greater flexibility in folding the newspaper.

SUMMARY OF THE INVENTION

Accordingly, it is an object of the present invention to provide a document holder that overcomes the disadvantages noted above.

The present invention achieves this and other objects through the provision of a document holder which comprises a supporting member having an upper member, a lower member, and a resilient member. The resilient member connects the upper member to the lower member and exerts a bias force to make the upper member substantially colinear with the lower member.

In one embodiment, the document holder according to the present invention includes a first and a second supporting member, and a hinge connecting an end of the first supporting member and to an end of the second supporting member. Each supporting member contains an upper member, a lower member, and a resilient member. The resilient member connects the upper member to the lower member and exerts a bias force to make the upper member substantially colinear with the lower member.

In another embodiment, the document holder according to the present invention includes a first and a second supporting member, and a hinge connecting an end of the first supporting member and to an end of the second supporting member. Each supporting member contains a first portion having a mortise, a second portion having a tenon, and an elastic element which exerts a bias force to maintain the tenon of the second portion in the mortise of the first portion.

BRIEF DESCRIPTION OF THE DRAWINGS

FIGS. 3A is a top and cross-sectional view of the upper section of the upper member of a supporting member of the document holder shown in FIG. 1.

FIG. 3B is a bottom view of the upper section of the upper member a supporting member of the document holder shown in FIG. 1.

FIG. 3C is a top cross-sectional view of the upper section of the upper member of a supporting member of the document holder shown in FIG. 1.

FIG. 4A a top, cross-sectional view of the middle section of the upper member of a supporting member of the document holder shown in FIG. 1.

DETAILED DESCRIPTION OF THE PREFERRED EMBODIMENTS

Figure 1:
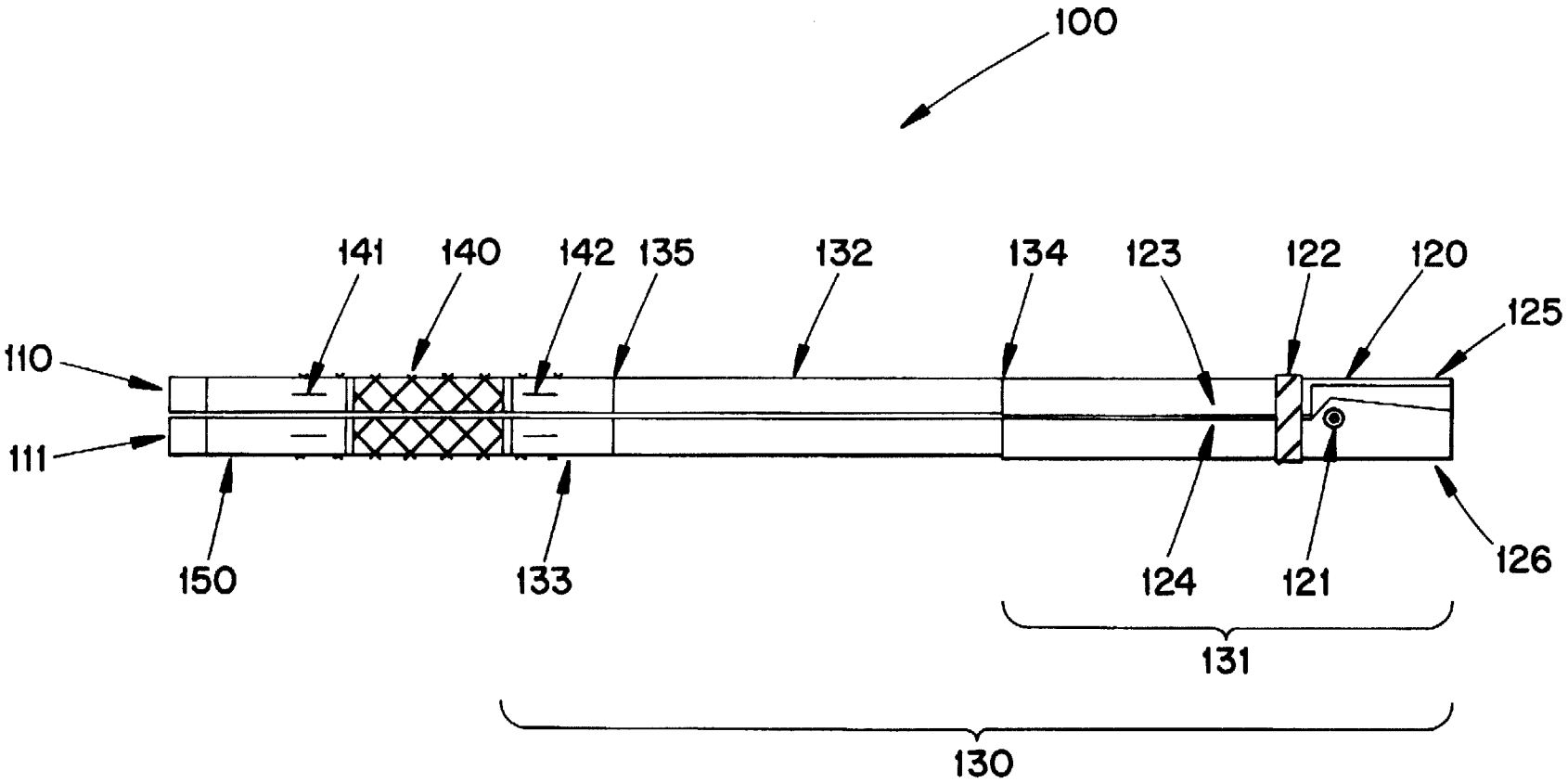
FIG. 1 is a top view of a document holder in an extended condition according to the present invention.

FIG. 1 illustrates a document holder according to a preferred exemplary embodiment of the present invention. The document holder is suitable for use with a variety of periodicals, e.g., newspapers, magazines, or other folded reading materials. The document holder is particularly suited for use with newspapers.

As shown in FIG. 1, the document holder 100 comprises two supporting members 110 and 111. Each of the supporting members 110 and 111 is identical to the other. The supporting members 110 and 111 are joined at one end to form a hinge 120. The hinge 120 allows one supporting member 110 to rotate about an axis 121 with respect to the other supporting member 111. The supporting members 110 and 111 may be rotatably fixed to each other at the axis 121 with a rivet or other connecting device such as a nut and bolt.

The document holder 100 is provided with an elastic element 122, such as a rubber band, proximate the hinge 120 to exert a bias force on the two supporting members 110 and 111 to keep them together. In lieu of the elastic element 122, the hinge 120 can be provided with a coil or spring element (not shown) which would serve the same function.

At least a portion 123 and 124 of the outer surface on the inside of each supporting member 110 and 111, proximate the hinge 120, is provided with a material having a greater coefficient of friction than the remaining surface of the supporting members 110 and 111 to better grip the document. The portions 123 and 124 are preferably provided with a pliable rubber strip or plastic tubing. Such a pliable material would allow the document holder 100 to firmly grip documents of different thicknesses.

Each supporting member 110 and 111 includes an upper member 130, a resilient member 140, and a lower member 150. The upper member 130, resilient member 140, and lower member 150 may be connected or attached to each other with staples 141 and 142, or other connecting device such as adhesives, screws, or rivets.

The upper member 130 and lower member 150 may be made of any material such that it has sufficient stiffness or rigidity to support the document. Exemplary materials include as wood, metal, or plastic. Preferably, the material is wood.

The resilient member 140 may be made of any material provided that (1) it has sufficient elasticity to allow the lower member 150 to be rotated relative to the upper member 130 at an angle of about −180° to about 180°, and (2) it can exert a bias force to make the upper member 130 substantially colinear with the lower member 150. The material can be plastic or metal. Preferably, the resilient member 140 is a thin curved metal strip such as the material used in a flexible and retractable measuring tape or a thin strong polyester film such as MYLAR.

The individual lengths of the upper member 130, resilient member 140, and lower member 150 may vary depending on the size of the document. Preferably, the length of the upper member 130 is such that when the document holder 100 is placed on the document, the resilient member 140 is aligned or overlaps with the horizontal crease of the document. The lower member 150 can have the same or different length (i.e., longer or shorter) than the upper member 130 depending on the location of the horizontal crease in the document as well as the degree of support required. Preferably, the length of the lower member 150 is about the same as the length of the upper member 130 (not shown).

In the case where the length of the lower member 150 is about the same as the length of the upper member 130, it is preferred that the distal ends of the lower member 150 and upper member 130 be provided with means for holding the document holder 100 with the document in place in a folded position for ease in handling and reading (not shown). Suitable means for such a purpose include elastic bands, velcro patches, and magnetic pads.

Additionally, it is preferred that the upper and lower members 130 and 150 have beveled or rounded edges for the comfort of the user as well as to prevent the document holder 100 from ripping or tearing the user's clothing or the document itself.

Figure 2:
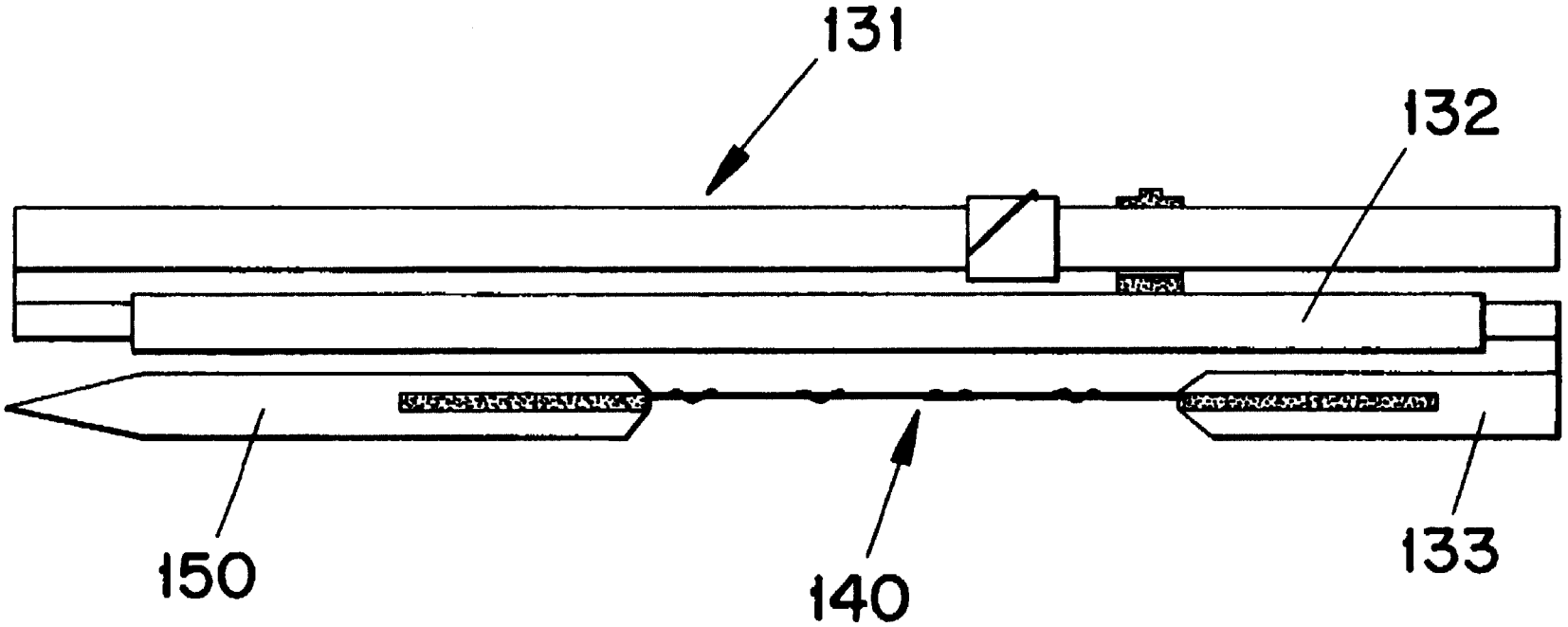
FIG. 2 is a side view of the document holder shown in FIG. 1 in a folded or collapsed condition.

As shown in FIG. 1, the upper member 130 comprises three sections: a top section 131; a middle section 132; and a bottom section 133. However, the upper member 130 may have more or less sections depending on the overall size of the upper member 130. The top section 131 is connected to the middle section 132 by a first joint 134. The middle section 132 is connected to the bottom section 133 with a second joint 135. Each joint allows the respective sections of the upper member 130 to be disengaged from one another. This enables the document holder 100 to be folded up or collapsed into three smaller portions for convenient storage as shown in FIG. 2. Each joint preferably comprises a mortise and a tenon.

FIG. 3A shows a top view of the top section 131 of the upper member 130 of the supporting member 111. The top section 131 contains a rubber tubing 124 embedded in a groove formed thereon. FIG. 3A also contains a cross-sectional view of the width of the top section 131.

FIG. 3B shows a bottom view of the top section 131. From this angle, a recess 30 can be seen in the top section 131. The recess 30 allows for two top sections to be assembled together to form the hinge 120.

FIG. 3C is a top, cross-sectional view of the top section 131. The top section 131 comprises a mortise 31 for receiving a tenon, a narrow channel 32 and a cavity 33. The narrow channel 32 and the cavity 33 are provided for holding one end of an elastic element (not shown) which runs through the upper member 130.

Figure 4A:
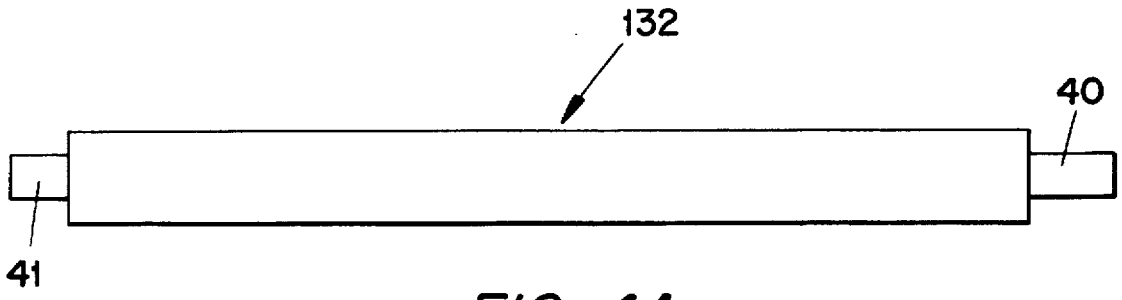
FIG. 4A is a top view of the middle section of the upper member of a supporting member of the document holder shown in FIG. 1.

FIG. 4A shows a top view of the middle section 132. The middle section 132 contains a first tenon 40 at one end and a second tenon 41 at an opposite end.

Figure 4B:
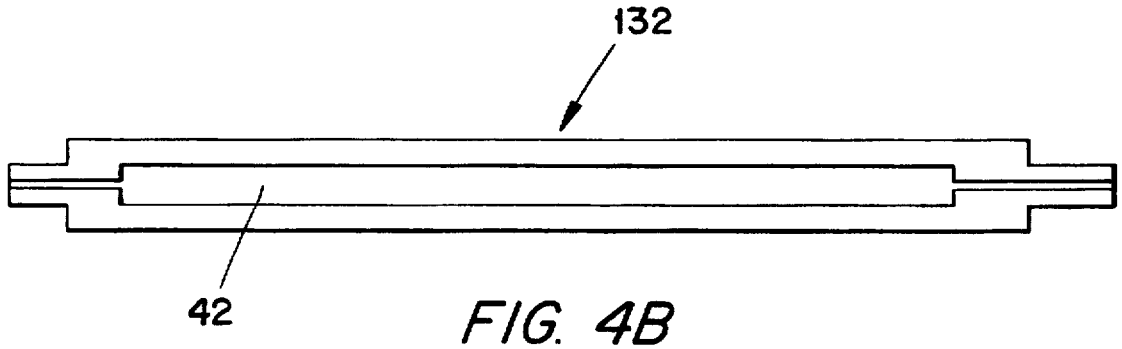

FIG. 4B is a top, cross-sectional view of the middle section 132. The middle section 132 has a cavity or channel 42 extending through a longitudinal axis thereof for holding the middle portion of an elastic element (not shown) which runs through the upper member 130.

Figure 5A:
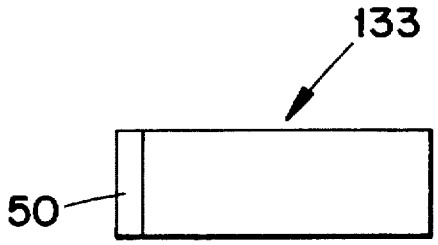
FIG. 5A is a top view of the bottom section of the upper member of a supporting member of the document holder shown in FIG. 1.

FIG. 5A shows a top view of the bottom section 133. The bottom section 133 contains a beveled edge 50 at one end thereof.

Figure 5B:
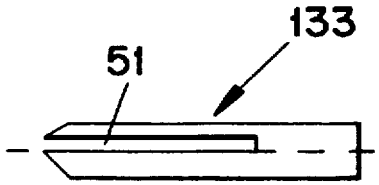
FIG. 5B is a side view of the bottom section of the upper member of a supporting member of the document holder shown in FIG. 1.

FIG. 5B is a side view of the bottom section 133. The bottom section 133 contains a slot 51 for receiving a portion of the resilient member 140.

Figure 5C:
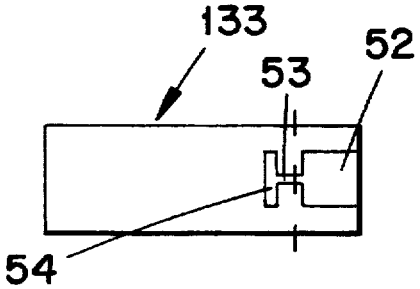
FIG. 5C is a top, cross-sectional view of the bottom section of the upper member of a supporting member of the document holder shown in FIG. 1.

FIG. 5C is a top, cross-sectional view of the bottom section 133. The bottom section 133 has a mortise 52 at the opposite end of the beveled edge 50 for receiving a tenon, a narrow channel 53, and a cavity 54. The narrow channel 53 and the cavity 54 are provided for holding an opposite end of an elastic element (not shown) which runs through the upper member 130.

Figure 6:
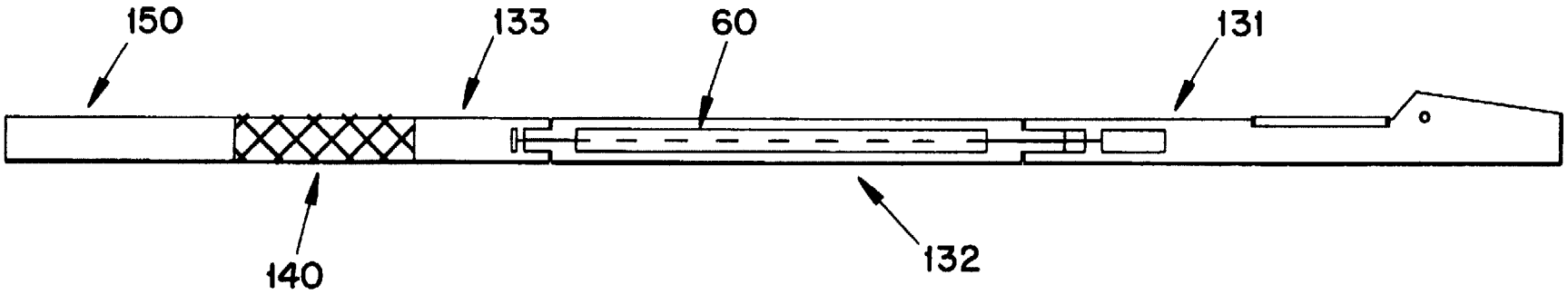
FIG. 6 is a top, cross-sectional view of a supporting member of the document holder shown in FIG. 1.

FIG. 6 is a top, cross-sectional view of the supporting member 111. As seen from FIG. 6, the top section 131, middle section 132, and bottom section 133 are joined together by mortises and tenons. In addition, there is provided an elastic element 60, such as an elastic cord knotted at the ends, inside the cavities and channels of the top 131, middle 132, and bottom 133 sections. The elastic element 60 exerts a force which maintains these sections in an engaged position.

Figure 7A:
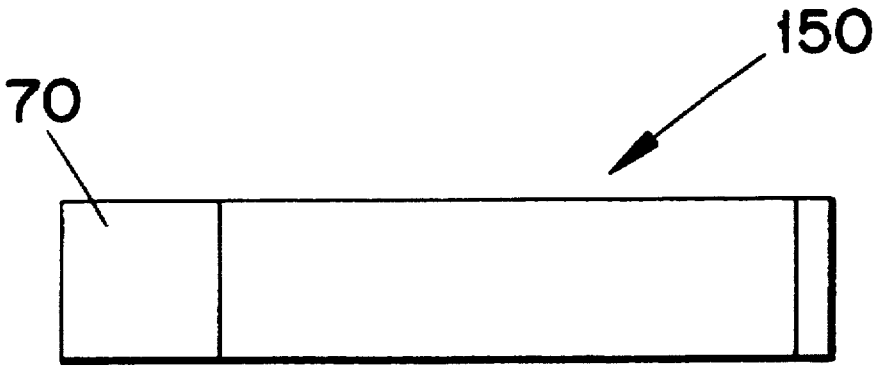
FIG. 7A is a top view of the lower member of a supporting member of the document holder shown in FIG. 1.

FIG. 7A shows a top view of the lower member 150. The lower member 150 has a beveled edge 70 at one end to facilitate insertion of the supporting member 110 or 111 into the spine or vertical crease of a document.

Figure 7B:
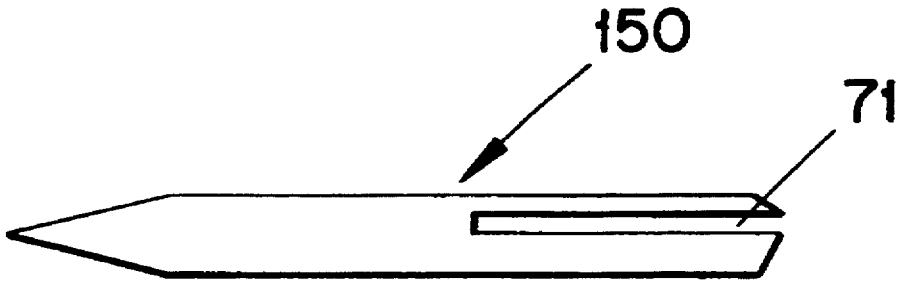
FIG. 7B is a side view of the lower member of a supporting member of the document holder shown in FIG. 1.

FIG. 7B is a side view of the lower member 150. The lower member 150 contains a slot 71 at an opposite end of the beveled edge 70 for receiving an end of the resilient member 140.

While the lower member 150 shown in the Figures have a shorter length than the upper member 130, the present invention contemplates embodiments wherein the lower member 150 is of the same or greater length than the upper member 130. The lower member 150 can also be made up of two or more sections joined together by mortise and tenon joints as in the upper member 130. Preferably, the lower member 150 and the upper member 130 collectively have four joints to allow the document holder 100 to be folded or collapsed into five smaller pieces for convenient storage and/or transport.

Referring back to FIG. 1, to install the document holder on a document, the two supporting members 110 and 111 are separated by applying pressure to the outer edges 125 and 126 of the hinge 120.

Figure 8A:
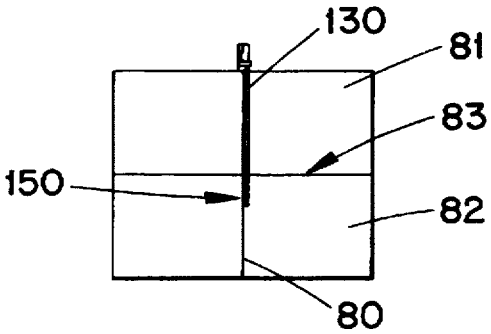
FIGS. 8A, 8B, 8C, and 8D show the document holder shown in FIG. 1 in operation with a newspaper.

As shown in FIG. 8A, one of the supporting members 110 or 111 is then inserted into the spine or vertical crease 80 of the document at page N/2, where N is the total number of pages in the document. The supporting member 110 or 111 should be inserted such that the upper member 130 is aligned with an upper portion 81 of the document, the lower member 150 is aligned with a lower portion 82 of the document, and the resilient member 140 is aligned or overlaps with a horizontal crease 83 of the document.

When the pressure applied on the outer edges 125 and 125 is released, the elastic element 122 forces the two supporting members 110 and 111 together, clamping the document between them.

Figure 8B:
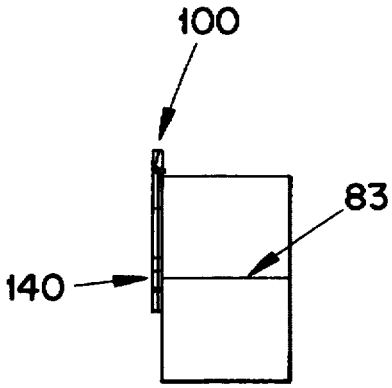
Figure 8C:
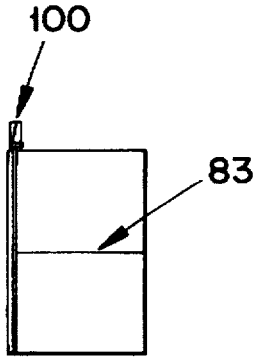

When the document holder 100 has been installed, pages of the document can be turned and wrapped around the document holder 100, as shown in FIGS. 8B and 8C.

Figure 8D:
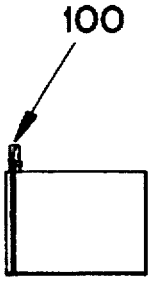

The resilient member 140, which is aligned with the horizontal crease 83 of the document, allows the document to be folded backwards or forwards while the document holder 100 is installed on the document, as shown in FIG. 8D.

From the above detailed description of a preferred exemplary embodiment, it can be seen that the document holder according to the present invention represents a significant improvement over prior art document holders in a number of ways. For example, the resilient member 140 allows the document holder 100 with a document inside to be founded backwards or forwards with ease. The resilient member 140 also exerts a bias force to aid the reader in unfolding the document.

In addition, mortise and tenon joints 134 and 135 in combination with an elastic element 60 allow the document holder 100 to be easily collapsed for convenient storage by pulling at opposite ends of the joints.

While not shown in the Figures, the document holder according to the present invention can be equipped with a holster or pocket for holding reading accessories such as a small pair of scissors for clipping coupons, a small pen for doing crossword puzzles, and a magnifying glass for reading small print. Moreover, the document holder can be provided with means for maintaining the document holder in a folded or collapsed position for easier storage and/or transport. Suitable means include elastic bands, velcro patches or magnetic pads placed at various locations along the document holder. For example, one or more elastic bards may be placed over the document holder when it is in the folded position to maintain the document holder in such a position.

While the present invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A document holder comprising a supporting member, said supporting member comprising:

(a) an upper member;

(b) a lower member; and (c) a resilient member which connects the upper member to the lower member and which exerts a bias force to make the upper member substantially colinear with the lower member, wherein the upper member and the lower member are connected to the resilient member with staples, adhesives, screws, or rivets, and wherein said supporting member comprises at least one joint which allows a first portion of the supporting member to be disengaged from a second portion of the supporting member.

2. The document holder of claim 1, wherein the resilient member allows the lower member to rotate from about −180° to about 180° relative to the upper member.

3. The document holder of claim 1, wherein the resilient member is a curved metal strip or a curved polyester strip.

4. The document holder of claim 1, wherein a portion of the outer surface of the supporting member has a greater coefficient of friction than a remaining portion thereof.

5. The document holder of claim 1, wherein said at least one joint comprises a mortise and a tenon.

6. The document holder of claim 1, wherein said supporting member comprises a cavity extending through a longitudinal axis thereof, said cavity comprising an elastic element which connects the first portion to the second portion and which maintains the first portion engaged to the second portion.

7. The document holder of claim 1, wherein the upper member has a length equal to or greater than a length of the lower member.

8. A document holder comprising:

(a) a first and a second supporting member, each supporting member comprising:

i) an upper member;

ii) a lower member; and iii) a resilient member which connects the upper member to the lower member and which exerts a bias force to make the upper member substantially colinear with the lower member, and (b) a hinge connecting an end of the first supporting member and to an end of the second supporting member.

9. The document holder of claim 8, wherein a portion of the outer surface of each of said first and second supporting members has a greater coefficient of friction than a remaining portion thereof.

10. The document holder of claim 8, wherein the hinge comprises a spring element or an elastic element which exerts a bias force making the first supporting member substantially parallel to the second supporting member.

11. The document holder of claim 8, wherein the resilient member allows the lower member to rotate from about −180° to about 180° relative to the upper member.

12. The document holder of claim 8, wherein the resilient member is a curved metal strip or a curved polyester strip.

13. The document holder of claim 8, wherein each of said first and second supporting members comprises at least one joint which allows a first portion of the supporting member to be disengaged from a second portion of the supporting member.

14. The document holder of claim 13, wherein said at least one joint comprises a mortise and a tenon.

15. The document holder of claim 13, wherein each of said first and second supporting members comprises a cavity extending through a longitudinal axis thereof, said cavity comprising an elastic element which connects the first portion to the second portion and which maintains the first portion engaged to the second portion.

16. The document holder of claim 9, wherein the upper member has a length equal to or greater than a length of the lower member.

17. A document holder comprising:

(a) a first and a second supporting member, each supporting member comprising:

i) a first portion having a mortise;

ii) a second portion having a tenon; and iii) an elastic element which exerts a force to maintain the mortise of the first portion in the tenon of the second portion, and (b) a hinge connecting an end of the first supporting member and to an end of the second supporting member.

18. The document holder of claim 17, wherein the hinge comprises a spring element or an elastic element which exerts a bias force making the first supporting member substantially parallel to the second supporting member.

19. The document holder of claim 17, wherein each of said first and second supporting members further comprises:

an upper member;

a lower member; and a resilient member which connects the upper member to the lower member and which exerts a bias force to make the upper member substantially colinear with the lower member.

* * * * *